US005454341A

United States Patent [19]

Bensley et al.

[11] Patent Number: 5,454,341

[45] Date of Patent: Oct. 3, 1995

[54] PROTECTIVE HULL LINER

[76] Inventors: Alan B. Bensley, 357 Buckskin Dr.; Michael D. Oeser, 2720 Palisades Dr., Unit 2, both of Lake Havasu City, Ariz. 86404

[21] Appl. No.: 385,454

[22] Filed: Feb. 8, 1995

[51] Int. Cl.[6] ..... B63B 17/00

[52] U.S. Cl. ..... 114/343; 114/361; 114/219; 405/1

[58] Field of Search ..... 114/219, 221, 114/361, 343; 405/1

[56] References Cited

U.S. PATENT DOCUMENTS 4,909,172 3/1990 Hamby ..... 114/343
4,962,719 10/1990 Hughes et al. ..... 114/361
4,972,791 11/1990 Williams ..... 114/361
5,357,890 10/1994 Mason, Jr. et al. ..... 114/343

*Primary Examiner*—Jesus D. Sotelo

[57] ABSTRACT

A new and improved protective hull liner comprised of a mat having a generally rectangular configuration. The mat has an upper surface and a lower surface. The upper surface comprises a foam rubber material. The lower surface comprises a puncture-resistant rubber material. The mat has a first edge and a second edge. The upper surface has a hook and loop material strip secured thereto inward of the first edge of the mat. The lower surface has a hook and loop material strip secured thereto inward of the second edge of the mat. The hook and loop material strip of the first edge cooperates with the hook and loop material strip of the second edge in a rolled configuration.

5 Claims, 4 Drawing Sheets

PROTECTIVE HULL LINER

BACKGROUND OF THE INVENTION

1. Field of the Invention

The present invention relates to a protective hull liner and more particularly pertains to protecting the hull of a boat when it is moored onto a shoreline with a protective hull liner.

2. Description of the Prior Art

The use of bow protectors is known in the prior art. More specifically, bow protectors heretofore devised and utilized for the purpose of protecting the bottom surface of the boat are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,117,764 to Kretzer, Jr. discloses a protective hull liner for jet skis.

U.S. Pat. No. 4,815,412 to Cassaro, Jr. discloses a boat bow protector.

U.S. Pat. No. 4,751,891 to Wilson discloses a bow protector.

U.S. Pat. No. 4,667,619 to Nishida discloses a bottom protector for a small boat.

U.S. Pat. No. 3,693,574 to Dickey discloses a portable boat landing apparatus.

While these devices fulfill their respective, particular objective and requirements, the aforementioned patents do not describe a protective hull liner for protecting the hull of a boat when it is moored onto a shoreline.

In this respect, the protective hull liner according to the present invention substantially departs from the conventional concepts and designs of the prior art, and in doing so provides an apparatus primarily developed for the purpose of protecting the hull of a boat when it is moored onto a shoreline.

Therefore, it can be appreciated that there exists a continuing need for a new and improved protective hull liner which can be used for protecting the hull of a boat when it is moored onto a shoreline. In this regard, the present invention substantially fulfills this need.

SUMMARY OF THE INVENTION

In the view of the foregoing disadvantages inherent in the known types of bow protectors now present in the prior art, the present invention provides an improved protective hull liner. As such, the general purpose of the present invention, which will be described subsequently in greater detail, is to provide a new and improved protective hull liner and method which has all the advantages of the prior art and none of the disadvantages.

To attain this, the present invention essentially comprises a mat having a generally rectangular configuration. The mat has a horizontal length of about six feet and a vertical length of about four feet. The mat has an upper surface and a lower surface. The upper surface is comprised of a foam rubber material. The foam rubber material has a thickness of about ¼ of an inch. The lower surface is comprised of a puncture-resistant rubber material. The puncture resistant material has a thickness of about ⅜ of an inch. The mat has a first edge and a second edge. The upper surface has a hook and loop material strip secured thereto inward of the first edge of the mat. The lower surface has a hook and loop material strip secured thereto inward of the second edge of the mat. The hook and loop material strip of the first edge cooperates with the hook and loop material strip of the second edge in a rolled configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective hull liner which has all the advantages of the prior art bow protectors and none of the disadvantages.

It is another object of the present invention to provide a new and improved protective hull liner which may be easily and efficiently manufactured and marketed.

It is a further object of the present invention to provide a new and improved protective hull liner which is of durable and reliable construction.

An even further object of the present invention is to provide a new and improved protective hull liner which is susceptible of a low cost of manufacture with regard to both materials and labor, and which accordingly is then susceptible of low prices of sale to the consuming public, thereby making such a protective hull liner economically available to the buying public.

Still yet another object of the present invention is to provide a new and improved protective hull liner which provides in the apparatuses and methods of the prior art some of the advantages thereof, while simultaneously overcoming some of the disadvantages normally associated therewith.

Even still another object of the present invention is to provide a new and improved protective hull liner for protecting the hull of a boat when it is moored onto a shoreline.

Lastly, it is an object of the present invention to provide a new and improved protective hull liner comprised of a mat having a generally rectangular configuration. The mat has an upper surface and a lower surface. The upper surface comprises a foam rubber material. The lower surface comprises a puncture-resistant rubber material. The mat has a first edge and a second edge. The upper surface has a hook and loop material strip secured thereto inward of the first edge of the mat. The lower surface has a hook and loop material strip secured thereto inward of the second edge of the mat. The hook and loop material strip of the first edge cooperates with the hook and loop material strip of the second edge in a rolled configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
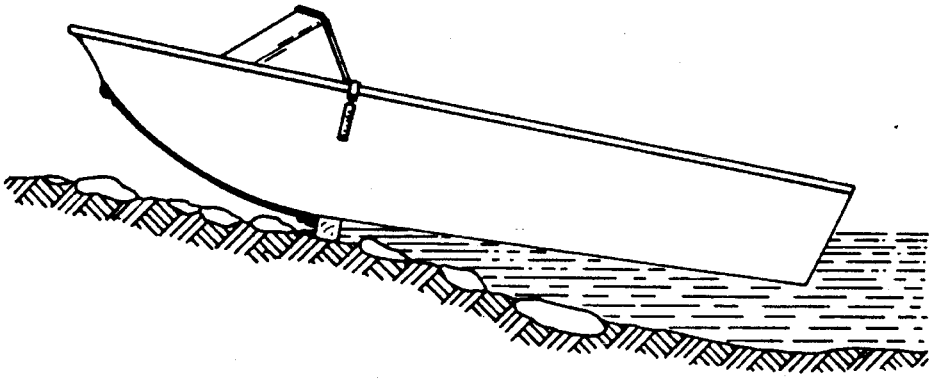
PRIOR ART FIG. 1
FIG. 1 is a side elevational view of the prior art portable boat landing apparatus.
Figure 2:
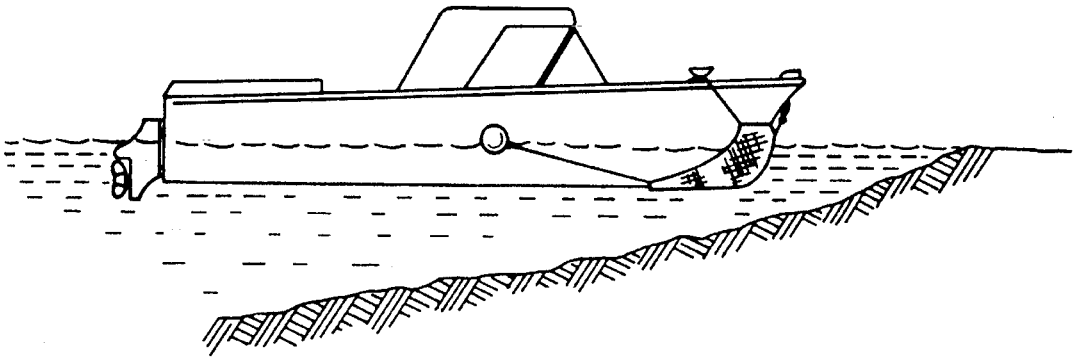
PRIOR ART FIG. 2
FIG. 2 is a side view of the prior art boat bow protector.
Figure 3:
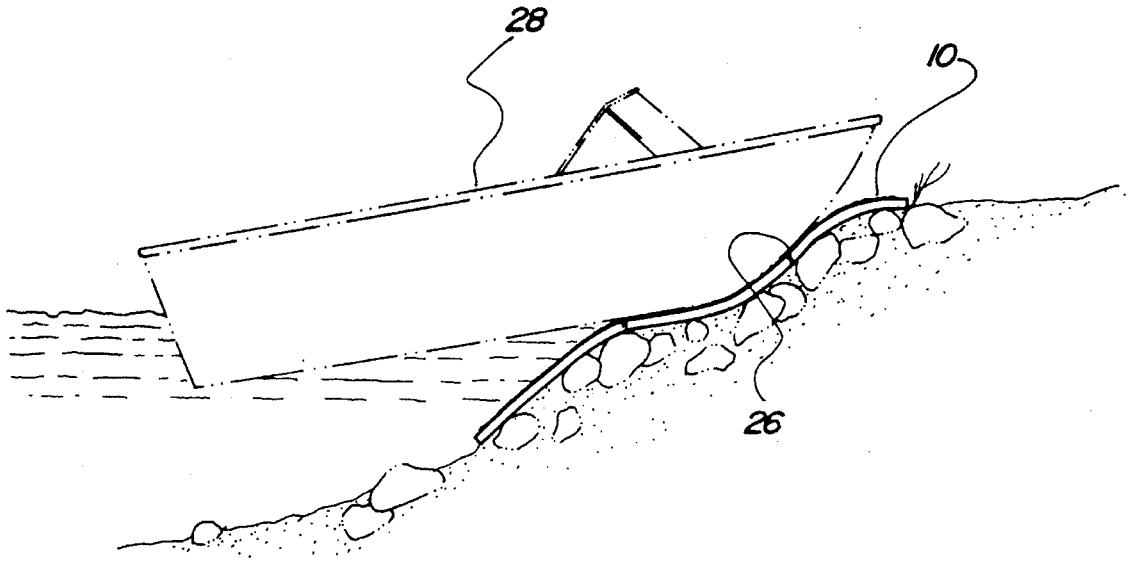
FIG. 3 is a perspective view of the preferred embodiment of the protective hull liner constructed in accordance with the principles of the present invention.
Figure 4:
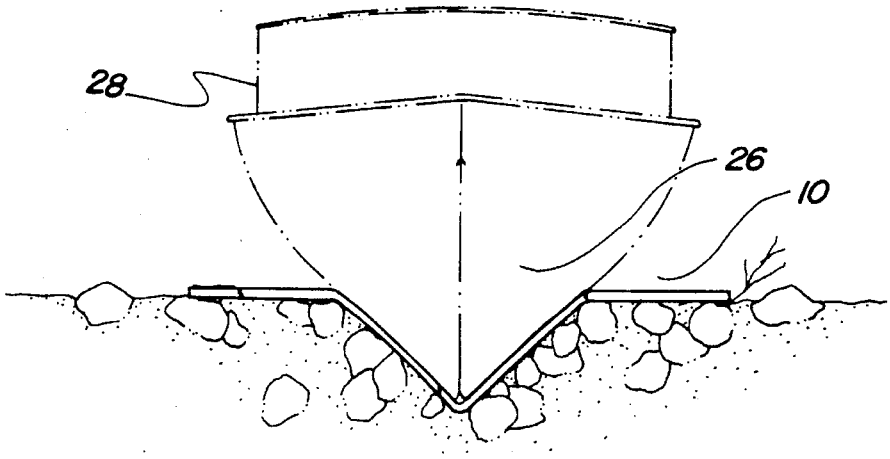
FIG. 4 is a front view of the present invention in rise.
Figure 5:
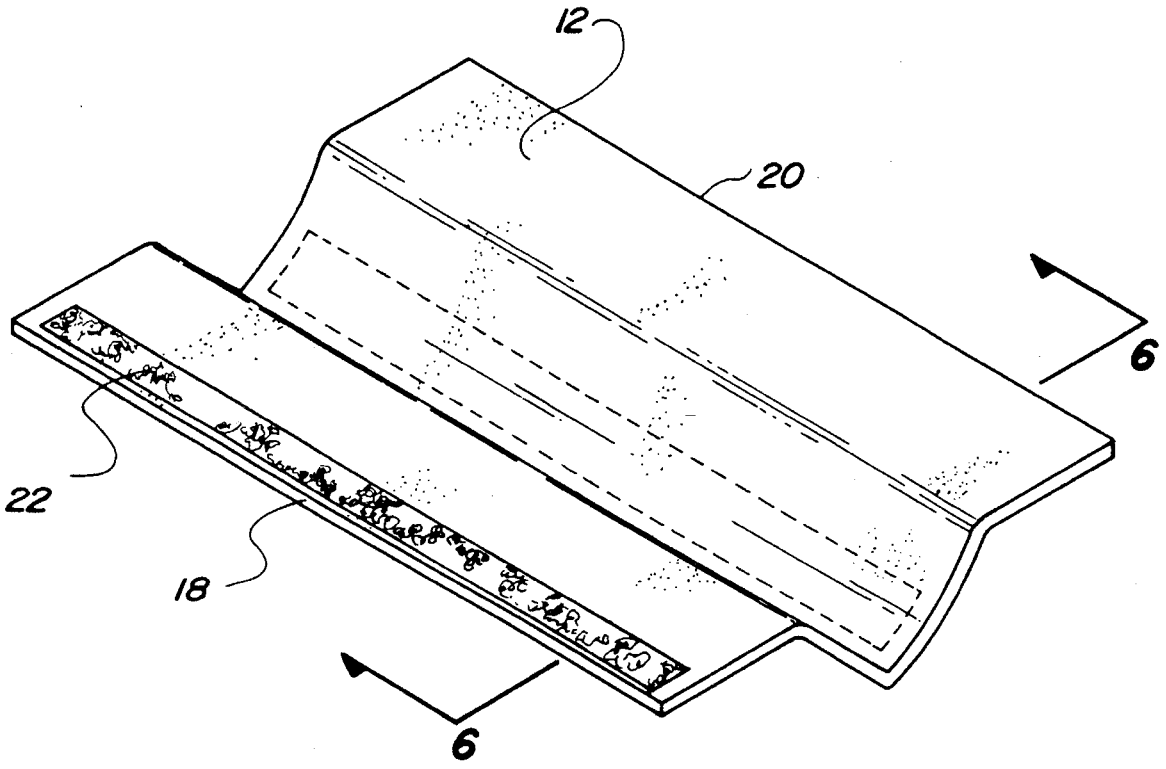
FIG. 5 is a perspective view of the present invention.
Figure 6:
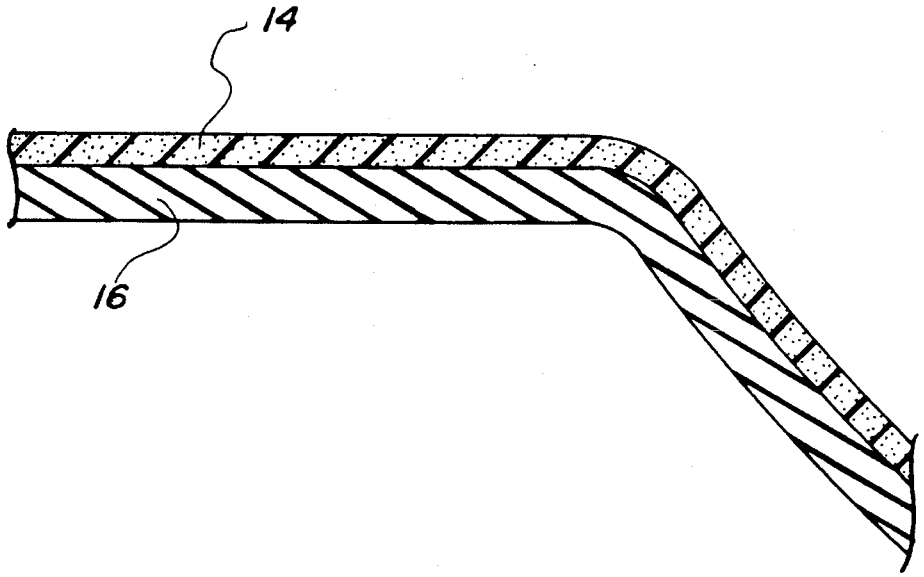
FIG. 6 is a cross-sectional view as taken along line 6—6 of FIG. 5.
Figure 7:
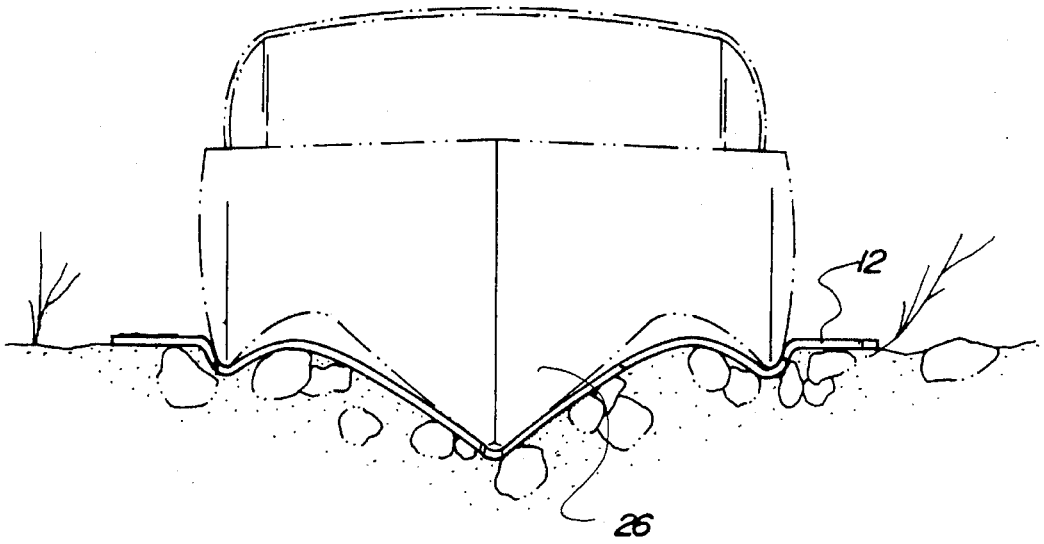
FIG. 7 is a front elevational view of a second embodiment of the present invention in use.
Figure 8:
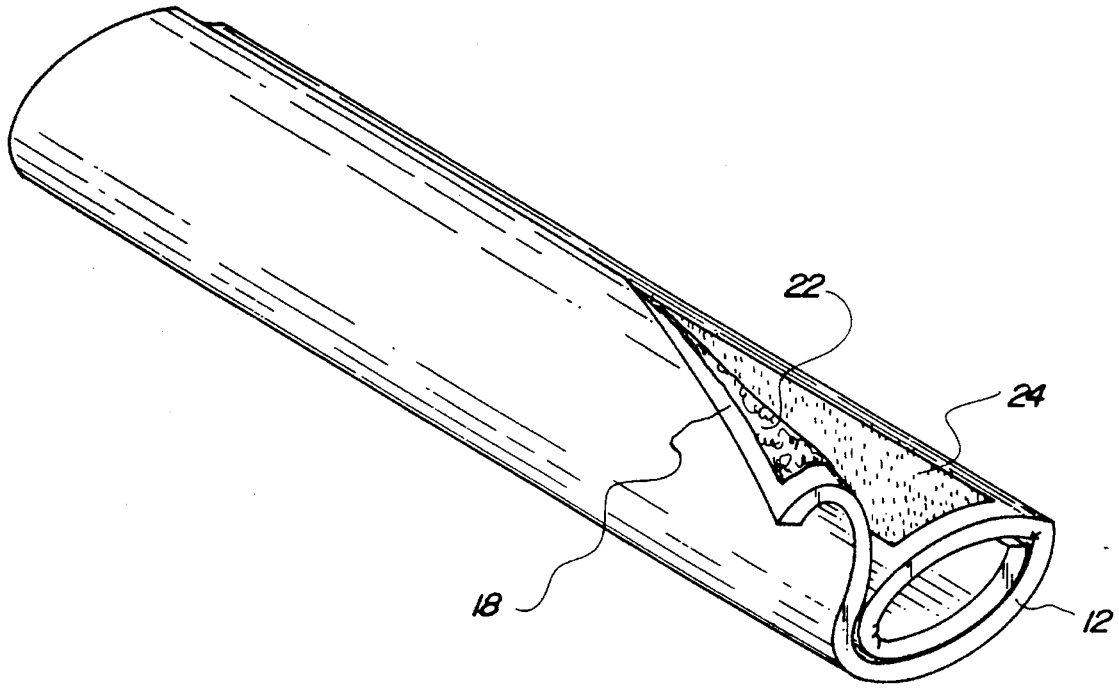
FIG. 8 is a perspective view of the present invention in a rolled configuration.

With reference now to the drawings, and in particular to FIG. 3 thereof, the preferred embodiment of the new and improved protective hull liner embodying the principles and concepts of the present invention and generally designated by the reference number 10 will be described.

Specifically, it will be noted in the various Figures that the device relates to a new and improved protective hull liner for protecting the hull of a boat when it is moored onto a shoreline.

The device 10 consists of a mat 12 having a generally rectangular configuration. The mat 12 has a horizontal length of about six feet and a vertical length of about four feet. The mat 12 has an upper surface 14 and a lower surface 16. The upper surface 14 is comprised of a foam rubber material. The foam rubber material has a thickness of about ¼ of an inch. The lower surface 16 is comprised of a puncture-resistant rubber material. The puncture resistant material has a thickness of about ⅜ of an inch. The mat 12 has a first edge 18 and a second edge 20. The upper surface 14 has a hook and loop material strip 22 secured thereto inward of the first edge 18 of the mat 12. The lower surface 16 has a hook and loop material strip 24 secured thereto inward of the second edge 20 of the mat 12. The hook and loop material strip 22 of the first edge 18 cooperates with the hook and loop material strip 24 of the second edge 20 in a rolled configuration.

The present invention is a cushioned pad or mat 12 that is placed over rocks or brush on the shoreline of a lake, river or other body of water, to protect the hull 26 of a boat 28 when it is moored onto the shoreline.

It is rectangular in shape and consists of a layer of tough, puncture proof rubber lower surface 16, and an upper surface 14 of waterproof foam rubber. The upper surface 14 is approximately ¼ inch thick and the hard rubber layer is approximately ⅜ inch thick. Its length and width will vary with the size and style of the boat 28 it is intended to protect. For example, a thirty foot boat could require a mat 12 that is six feet long and four feet wide, where a catamaran or tri-hull may require a mat 12 of much greater width. The mat's 12 thickness will also vary accordingly. The lower surface 16 is of a material such that, when placed in the water at the shoreline, it will sink and cover the rocks or brush present. Hook and loop strips 22,24 are attached along the sides of the mat 12 to secure it when it is rolled up for storage.

The boat's owner or operator simply places the mat 12 on top of the rocks or brush at the shore's edge, then pulls or drives the fore section of the boat's 28 hull 26 over the mat 12 and secures the boat in place.

This device enables a boat operator to moor his boat 28 on a shoreline containing rocks or brush without scratching or damaging the boat's 28 hull 26.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A protective hull liner for protecting the hull of a boat when it is moored onto a shoreline comprising, in combination:

a mat having a generally rectangular configuration, the mat having a horizontal length of about six feet and a vertical length of about four feet, the mat having an upper surface and a lower surface, the upper surface comprising a foam rubber material, the foam rubber material having a thickness of about ¼ of an inch, the lower surface comprising a puncture-resistant rubber material, the puncture resistant material having a thickness of about ⅜ of an inch, the mat having a first edge and a second edge, the upper surface having a hook and loop material strip secured thereto inward of the first edge of the mat, the lower surface having a hook and loop material strip secured thereto inward of the second edge of the mat, the hook and loop material strip of the first edge cooperating with the hook and loop material strip of the second edge in a rolled configuration.

2. A protective hull liner for protecting the hull of a boat when it is moored onto a shoreline comprising:

a mat having a generally rectangular configuration, the mat having an upper surface and a lower surface, the upper surface comprising a foam rubber material, the lower surface comprising a puncture-resistant rubber material, the mat having a first edge and a second edge, the upper surface having a hook and loop material strip secured thereto inward of the first edge of the mat, the lower surface having a hook and loop material strip secured thereto inward of the second edge of the mat, the hook and loop material strip of the first edge cooperating with the hook and loop material strip of the second edge in a rolled configuration.

3. The liner as described in claim 2 and further including wherein the foam rubber material has a thickness of about ¼ of an inch and the puncture resistant material has a thickness of about ⅜ of an inch.

4. The liner as described in claim 3 and further including wherein the mat has a length of about six feet and a width of about four feet.

5. The liner as described in claim 3 and further including wherein the mat has a length of about twelve feet to accommodate a catamaran or tri-hulled boat.

* * * * *